US010051960B1

(12) United States Patent
Siebert et al.

(10) Patent No.: US 10,051,960 B1
(45) Date of Patent: Aug. 21, 2018

(54) COMBINATION CHAIR AND DESK APPARATUS

(71) Applicant: Brunswick Corporation, Lake Forest, IL (US)

(72) Inventors: Paul Brian Siebert, Chicago, IL (US); Jess Allen Sorel, Oakland, CA (US)

(73) Assignee: Brunswick Corporation, Mettawa, IL (US)

( * ) Notice: Subject to any disclaimer, the term of this patent is extended or adjusted under 35 U.S.C. 154(b) by 336 days.

(21) Appl. No.: 14/956,504

(22) Filed: Dec. 2, 2015

(51) Int. Cl.
*A47B 85/04* (2006.01)
*A47B 13/16* (2006.01)
*A47B 13/00* (2006.01)

(52) U.S. Cl.
CPC ..... *A47B 85/04* (2013.01); *A47B 13/003* (2013.01); *A47B 13/16* (2013.01)

(58) Field of Classification Search
CPC ..... A47B 85/04; A47B 13/003; A47B 13/16
USPC ..... 297/3, 119, 423.44
See application file for complete search history.

(56) References Cited

U.S. PATENT DOCUMENTS 3,667,803 A * 6/1972 Ford ..... A47B 85/00 297/119 X
4,773,337 A 9/1988 Ball
4,986,195 A 1/1991 Diffrient
D314,878 S 2/1991 Hart
5,121,697 A 6/1992 Baum et al.
D327,796 S 7/1992 Ryaa
5,174,225 A 12/1992 Reise et al.
5,354,027 A 10/1994 Cox
D450,466 S 11/2001 Overthun et al.
6,748,873 B2 6/2004 Brown, Sr.
D503,572 S 4/2005 Eldoy
6,883,863 B2 4/2005 Ginns
7,025,415 B1 * 4/2006 Wu ..... A47C 9/002 297/119
7,341,307 B2 * 3/2008 Parker ..... A47C 13/00 108/13
D596,415 S 7/2009 Wold
D596,416 S 7/2009 Wold
7,891,677 B2 2/2011 Jenkins
D644,456 S 9/2011 Martin
8,051,784 B2 11/2011 Hsu
8,171,863 B2 5/2012 Nyenhuis et al.
(Continued)

OTHER PUBLICATIONS

Steelcase Product Webpage "Leap Lounge Ergonomic Office Chair" (http://www.steelcase.com/products/lounge-seating/leap-lounge-chair/).

(Continued)

*Primary Examiner* — Anthony Derrell Barfield
(74) *Attorney, Agent, or Firm* — Andrus Intellectual Property Law, LLP

(57) ABSTRACT

A combination chair and desk apparatus includes a frame, a stationary member connected to the frame, a pivot member that is pivotable with respect to the stationary member between a chair position and a table position, and a latching device that latches the pivot member to the stationary member in the chair position and alternately in the table position. The pivot member includes a chair surface and a table surface that is transverse to the chair surface. When the pivot member is in the chair position, the chair surface is oriented for supporting a user, and when the pivot member is in the table position, the table surface is oriented for supporting an object.

16 Claims, 7 Drawing Sheets

(56) References Cited

U.S. PATENT DOCUMENTS

| | | | | |
|---|---|---|---|---|
| 8,359,983 | B2 | 1/2013 | Williamson et al. | |
| 8,573,688 | B2 | 11/2013 | Shackelford | |
| D705,556 | S | 5/2014 | Udagawa | |
| 8,720,989 | B2 | 5/2014 | Jurcic et al. | |
| 8,840,175 | B2 | 9/2014 | Short | |
| D720,161 | S | 12/2014 | Udagawa | |
| 9,144,300 | B2 | 9/2015 | Coety | |
| D764,847 | S | 8/2016 | Strater | |
| 2007/0063555 | A1 | 3/2007 | Ehud | |
| 2007/0095257 | A1 | 5/2007 | Hernandez | |
| 2015/0282623 | A1 | 10/2015 | Reddig | |
| 2017/0273181 | A1* | 9/2017 | Sohn | H05K 1/09 |

OTHER PUBLICATIONS

Pending Design U.S. Appl. No. 29/536,608, filed Aug. 18, 2015, entitled "Perch Chair", Sievert et al.
Pending Design U.S. Appl. No. 29/536,608, filed Aug. 18, 2015.
Pending Design U.S. Appl. No. 29/574,390, filed Aug. 15, 2016.
Kinema Active Chair, http://www.kinemaproducts.com/index.html, website visited Aug. 18, 2015.

* cited by examiner

COMBINATION CHAIR AND DESK APPARATUS

FIELD

The present disclosure relates to combination chair and desk apparatuses.

BACKGROUND

The following U.S. patent is incorporated herein by reference in entirety:

U.S. Pat. No. 9,144,300 discloses an article of furniture that comprises a main body, a floor-engagement frame, a plurality of non-rolling floor-engagement members connected to the floor-engagement frame, and a plurality of rollers that are also connected to the floor-engagement frame. The rollers do not engage the floor when the article of furniture rests upon the floor in an ordinary state of usage but do engage the floor when the article of furniture is tilted at least fifteen degrees. The article can further comprise a pedestal that pivotally couples to the floor-engagement frame and that supports a table surface. A user interface can control a latch that holds the table surface perpendicular to the pedestal. Another user interface can control a latch that holds the table surface at a present vertical height when latched.

SUMMARY

This Summary is provided to introduce a selection of concepts that are further described herein below in the Detailed Description. This Summary is not intended to identify key or essential features from the claimed subject matter, nor is it intended to be used as an aid in limiting the scope of the claimed subject matter.

In certain examples, a combination chair and desk apparatus includes a frame, a stationary member connected to the frame, a pivot member that is pivotable with respect to the stationary member between a chair position and a table position, and a latching device that latches the pivot member to the stationary member in the chair position and alternately in the table position. The pivot member includes a chair surface and a table surface that is transverse to the chair surface. When the pivot member is in the chair position, the chair surface is oriented for supporting a user. When the pivot member is in the table position, the table surface is oriented for supporting an object.

In certain examples, the combination chair and desk apparatus includes a frame, a stationary member connected to the frame, a pivot member that is pivotable with respect to the stationary member between a chair position and a table position, and a latching device that latches the pivot member to the stationary member. The stationary member includes a first notch and a second notch that is transverse to the first notch. The pivot member includes a chair surface and a table surface. When the pivot member is in the chair position, the chair surface is oriented for supporting a user and the latching mechanism engages the first notch. When the pivot member is in the table position, the table surface is oriented for supporting an object and the latching mechanism engages the second notch.

In certain examples, the combination chair and desk apparatus includes a frame, a stationary member connected to the frame, a pivot member that is pivotable with respect to the stationary member between a chair position and a table position, and a latching device that latches the pivot member to the stationary member when the pivot member is in the chair position and alternately in the table position. The pivot member includes a chair surface and a table surface that is traverse to the chair surface. When the pivot member is in the chair position, the chair surface is oriented for supporting a user. When the pivot member is in the table position, the table surface is oriented for supporting an object. The latching device moves with respect to the pivot axis along an arc path as the pivot member moves between the chair position and the table position.

BRIEF DESCRIPTION OF THE DRAWINGS

Examples of the present disclosure are described with reference to the following drawing FIGURES. The same numbers are used throughout the FIGURES to reference like features and components.

DETAILED DESCRIPTION OF THE DRAWINGS

Figure 1:
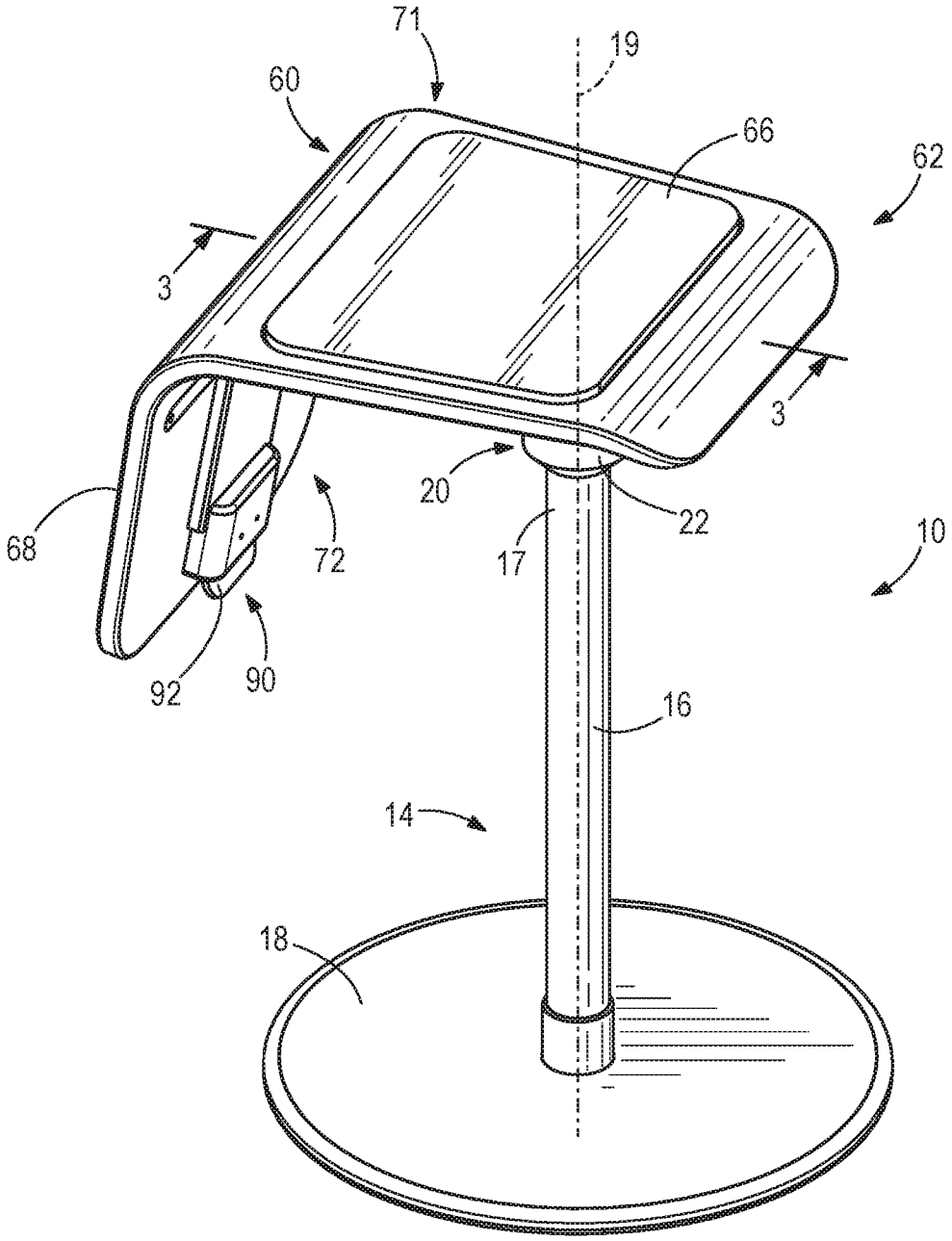
FIG. 1 is a combination chair and desk apparatus.
Figure 2:
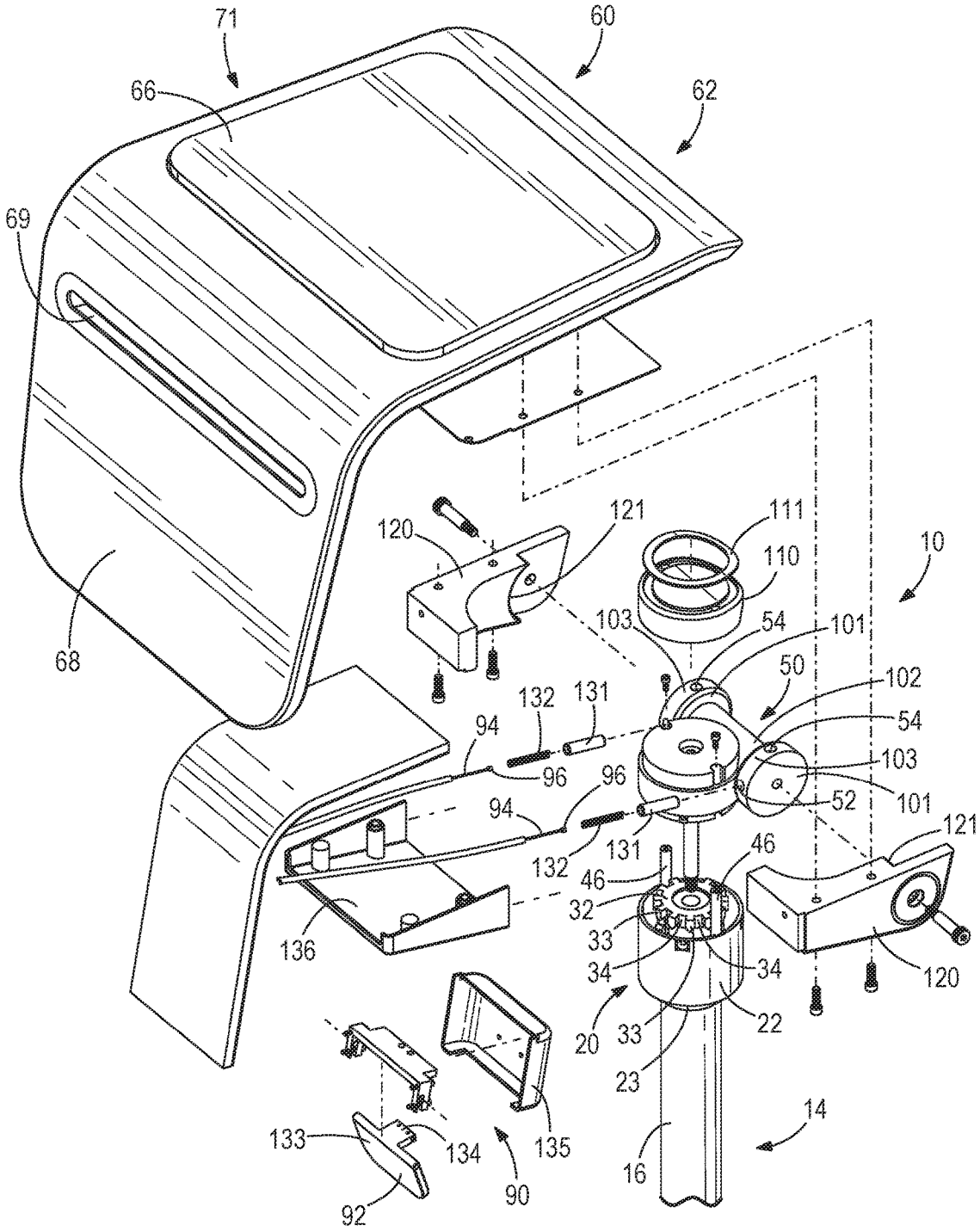
FIG. 2 is an exploded view of the apparatus in FIG. 1.

FIGS. 1-7 depict a combination chair and desk apparatus 10 including a frame 14, stationary member 50, pivot member 60, and latching device 90. The pivot member 60 is pivotable with respect to the stationary member 50 between a chair position 62 (see FIG. 3) and a table position 64 (see FIG. 4), and the latching device 90 latches the pivot member 60 to the stationary member 50 in the chair position 62 and alternately in the table position 64.

The frame 14 vertically supports the stationary member 50, pivot member 60, and latching device 90 above the ground. The frame 14 includes a base 18, a column 16 extending upwardly from the base 18, and a restrictor device 20 connected to a top end 17 of the column 16. The base 18 prevents the apparatus 10 from tipping over, and the restrictor device 20 controls the rotation of the stationary member 50, pivot member 60, and latching device 90 with respect to a rotational axis 19. The base 18 and column 16 can vary in shape and be made of any suitable material such as plastic, metal, wood, and/or the like. The base 18 can also include castors, wheels, and/or any other suitable member that assists when moving the apparatus 10.

Figure 5:
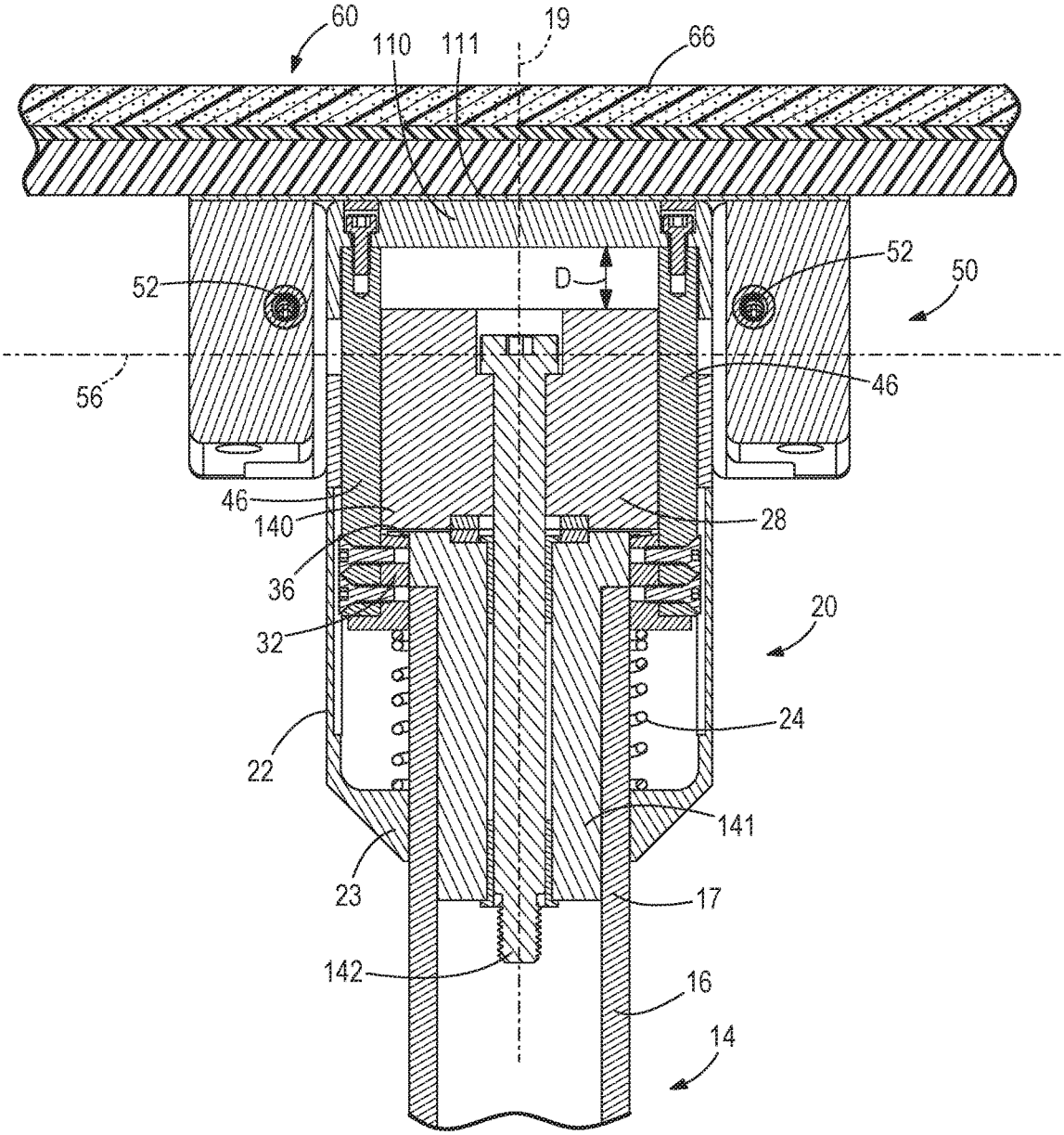
FIG. 5 is a view of section 3-3 of FIG. 3.
Figure 6:
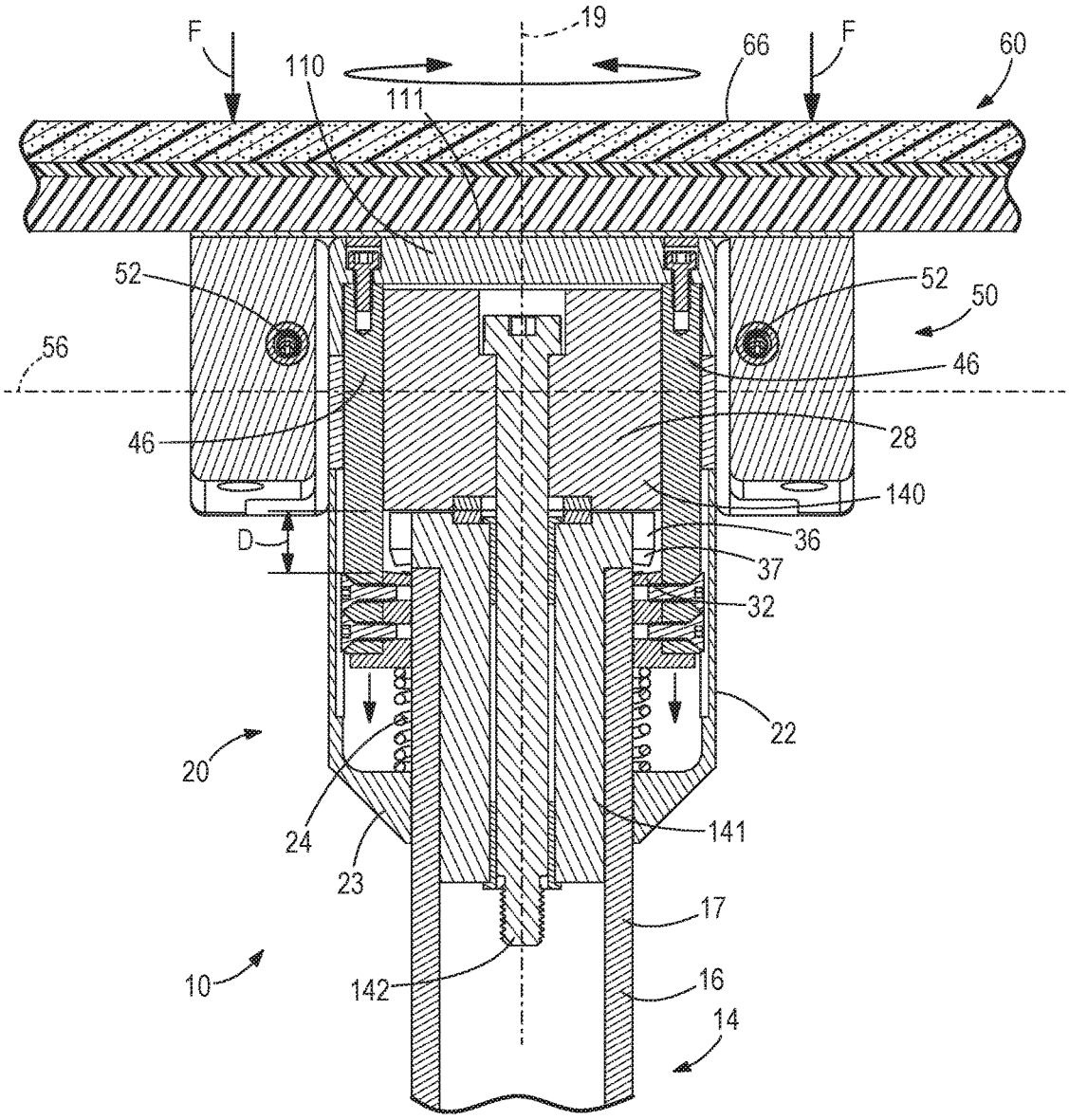
FIG. 6 is a view of section 3-3 of FIG. 3 with a force applied to a pivot member.
Figure 7:
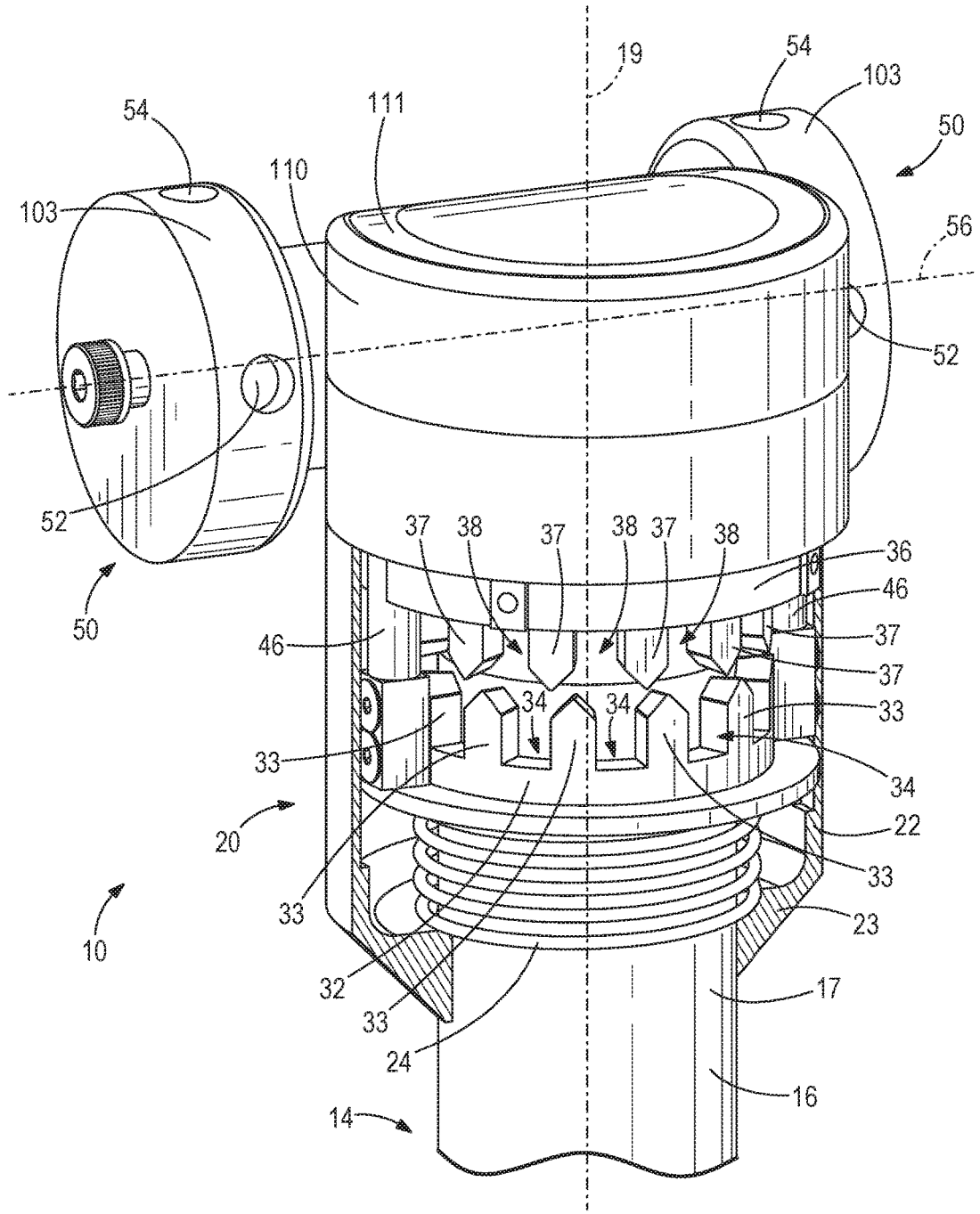
FIG. 7 is a perspective view of a portion of the apparatus with the pivot member removed and a collar cut away.

Referring to FIGS. 5-7, the restrictor device 20 includes a collar 22 which is connected to the top end 17 of the column 16. A spring 24 is positioned around the column 16 and axially between an outer wall 23 of the collar 22 and a lower locking member 32. (see FIG. 7). In other examples, the spring 24 can be positioned interior of the column 16. The lower locking member 32 is biased upwardly by the spring 24, and a dowel 46 couples the lower locking member 32 to the pivot member 60. (see FIG. 5). The lower locking member 32 includes upwardly orientated projections 33 which define voids 34 there between.

A retaining member 28 having an upper locking member 36 is coupled to the top end 17 of the column 16 to retain the spring 24 and the lower locking member 32 on the frame 14. The upper locking member 36 includes a plurality downwardly oriented projections 37 which define voids 38 there between. The projections 37 and the voids 38 mate with the voids 34 and projections 33 of the lower locking member 32, respectively, when the spring 24 biases the lower locking member 32 and the upper locking member 36 into mating engagement. The projections 33, 37 include sloped surfaces which allow aligned projections 33, 37 to move past one another if aligned. The locking members 32, 36 can take any shape and the projections 33, 37 and voids 34, 38 can be oriented in any direction. The retaining member 28 can include a plurality of number of components. In one example, the retaining member 28 includes an upper member 140 coupled to a lower member 141 by a retaining screw 142. (see FIGS. 5-6).

Referring to FIG. 5, the lower locking member 32 is biased upwardly by the spring 24 into the upper locking member 36 causing the dowels 46 and pivot member 60 to move upwardly a distance D. In this position, the mating of the projections 33, 37 and voids 34, 38, respectively, prevents the lower locking member 32, dowels 46, and pivot member 60 from rotating with respect to the rotational axis 19. Now referring to FIG. 6, a downward force F is applied to the pivot member 60 forcing the pivot member 60, dowels 46, lower locking member 32, and spring 24 downwardly along the rotational axis 19 the distance D such that the mated projections 33, 37 and voids 34, 38, respectively, separate thus allowing the pivot member 60, dowels 46, and lower locking member 32 to rotate with respect to the rotational axis 19. When downward force F is removed, the projections 33, 37 and voids 34, 38, re-mate preventing rotation, under the biasing force of the spring 24 described above. In some examples, the spring 24 biases the upper locking member 36 and the lower locking member 32 into mating engagement. In other examples, the upper locking member 36 may rotate with respect to the rotational axis 19.

The frame 14 can also include a cap 110 that is truncated such that the pivot member 60 does not contact the cap 110 when moving. The cap 110 includes an abutment surface 111 which contacts the pivot member 60 when the pivot member 60 is in the chair position 62. (see FIG. 3).

Figure 3:
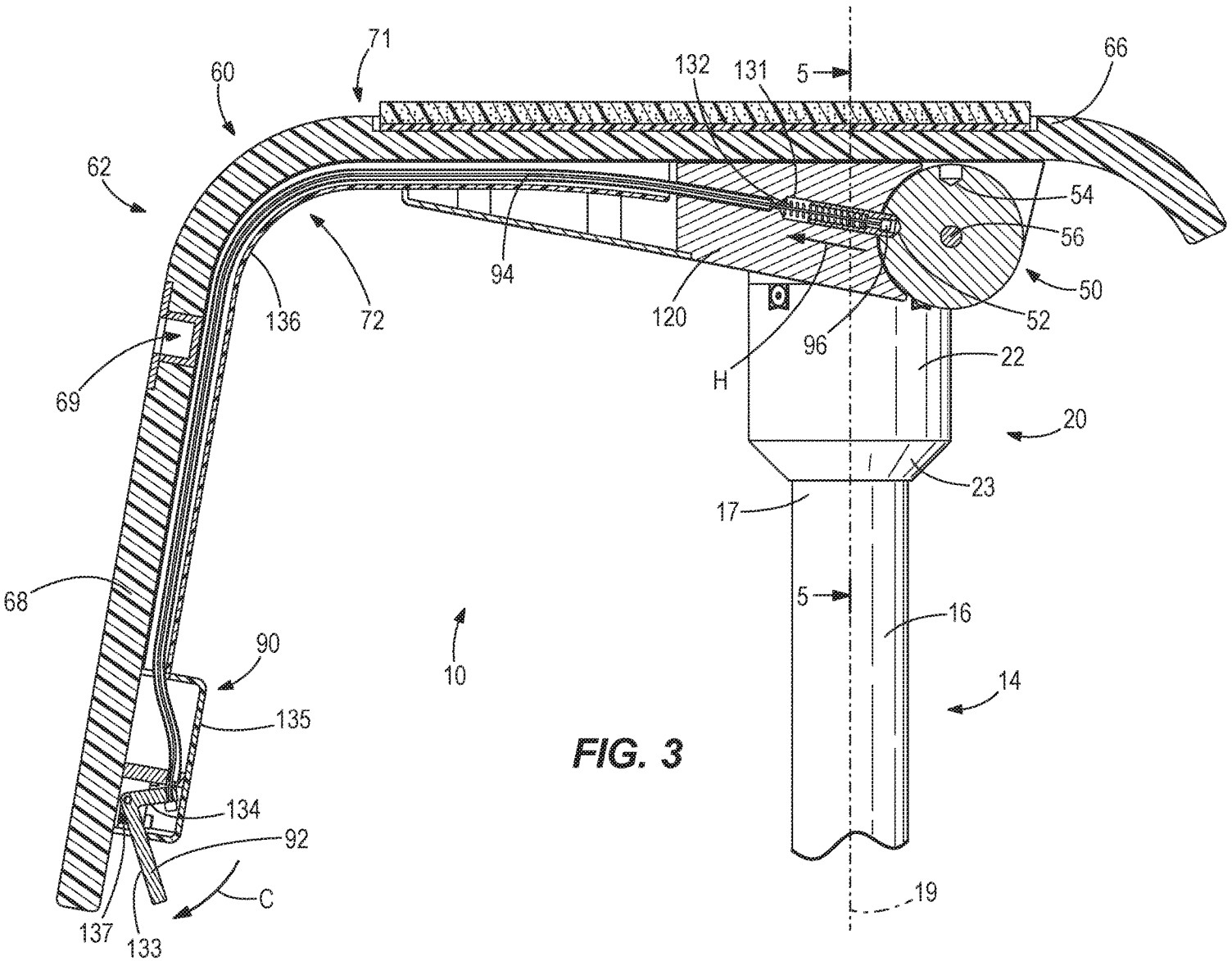
FIG. 3 is a cross sectional view of the apparatus of FIG. 1 in a chair position.
Figure 4:
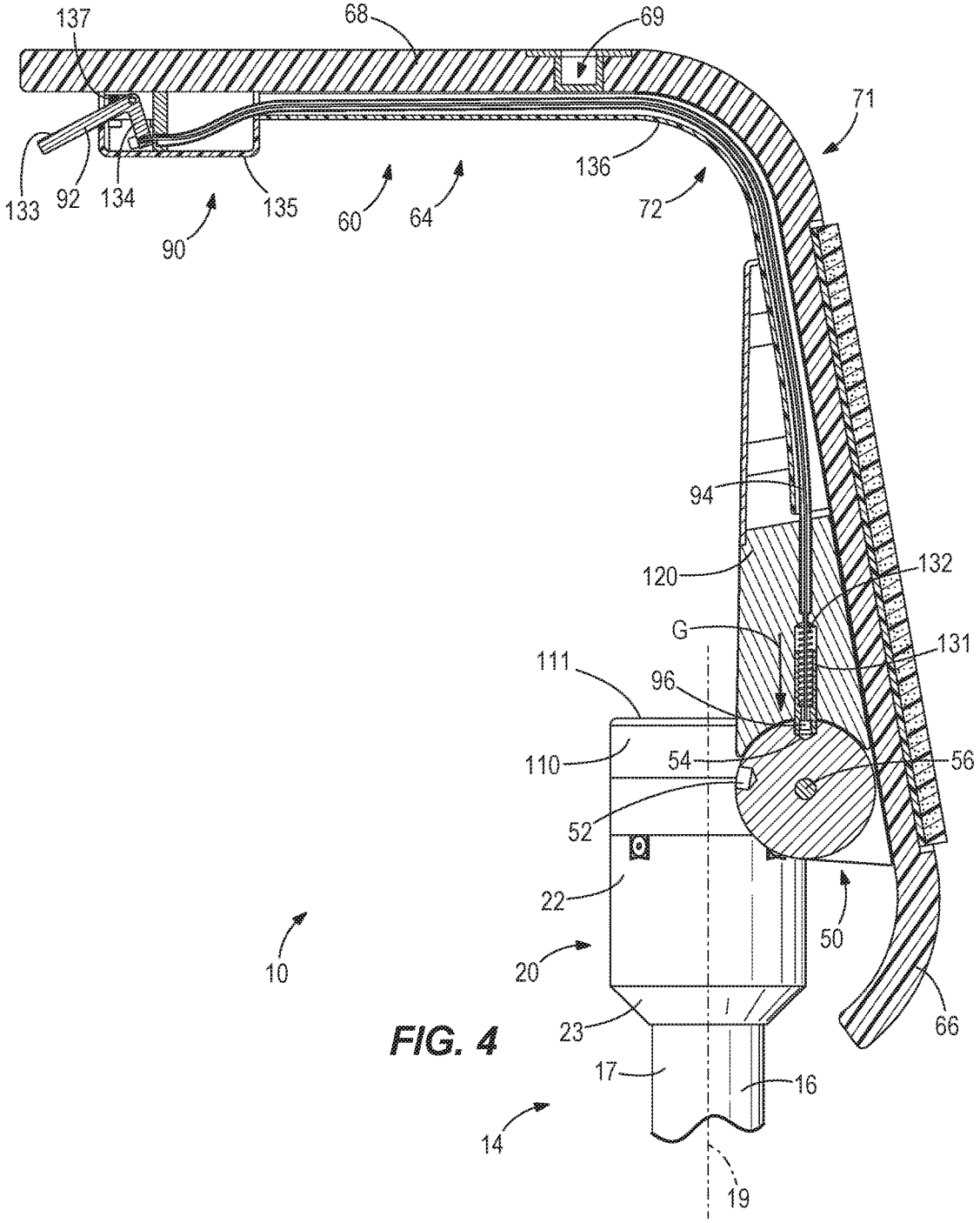
FIG. 4 is a cross sectional view of the apparatus of FIG. 1 in a table position.

Referring to FIGS. 3-4, the stationary member 50 is connected to the frame 14 and extends along a pivot axis 56. A first notch 52 and a second notch 54 are included with the stationary member 50 and extend radially with respect to the pivot axis 56. In some examples, the notches 52, 54 extend away from the stationary member 50. The shape of the stationary member 50 can vary and may be spherical, cylindrical, rectangular, and/or the like. The stationary member 50 can include a center member 102 connecting a pair of opposing ends 101. Each opposing end 101 can include the first notch 52 and second notch 54. A radially outer guide surface 103 is included at each end 101 and is intersected by the first notch 52 and the second notch 54.

The pivot member 60 is pivotable with respect to the stationary member 50 between the chair position 62 (see FIG. 3) and the table position 64 (see FIG. 4). The pivot member 60 includes a chair surface 66 and a table surface 68 that is transverse to the chair surface 66. Referring to FIG. 3, when the pivot member 60 is in the chair position 62, the chair surface 66 is oriented to support a user and is generally horizontal. Alternatively, referring FIG. 4, when the pivot member 60 is in the table position 64, the table surface 68 is oriented to support an object and is generally horizontal. Furthermore, when the pivot member 60 is in the table position 64, the table surface 68 higher than the chair surface 66 when the pivot member 60 is in the chair position 62. A recess 69 is formed in the table surface 68 for holding objects generally transverse to the table surface 68. The pivot member 60 has a first side 71 and a second side 72 opposite the first side 71. The chair surface 66 and the table surface 68 are on the first side 71. The pivot member 60 can include a pair of connection brackets 120 which engage with the stationary member 50. The connection brackets 120 can include a bracket surface 121 which is complementary and adjacent to the radially outer guide surface 103. (see FIG. 2). The bracket surface 121 slides along the radially outer guide surface 103 when the pivot member 60 moves between the chair position 62 and the table position 64.

The latching device 90 latches the pivot member 60 to the stationary member 50 in the chair position 62 and alternately in the table position 64. The latching device 90 includes a handle 92, a cable 94, and a pin 96. In the chair position 62, the latching device 90 engages the first notch 52. (see FIG. 3). Alternately, in the table position 64, the latching device 90 engages the second notch 54. (see FIG. 4). In one example, the pin 96 of the latching device 90 engages the first notch 52 in the chair position 62 and alternately the second notch 54 in the table position 64. The cable 94 connects the handle 92 to the pin 96. The handle 92 is coupled to the second side 72 of the pivot member 60 opposite the table surface 68. The cable 94 is coupled to and extends along with the second side 72 opposite both chair surface 66 and the table surface 68. Referring to FIG. 3, applying an actuation force C on the handle 92 which causes the latching device 90 to move the pin 96 out of engagement with the stationary member 50 (see arrow H) such that the pivot member 60 to rotate about the stationary member 50. Referring to FIG. 4, releasing the actuation force C from the handle 92 causes the latching device 90 to move the pin 96 to an engaged position with one notch 52, 54, in this example the second notch 54 (see arrow G). In one example, the latching device 90 moves with respect to the pivot axis 61 along an arc path as the pivot member 60 move between the chair position 62 and table position 64.

The latching device 90 can include guide sleeves 131 and pin springs 132 connected to the cable 94. (see FIG. 2). The guide sleeves 131 guide the pin 96 when the pin 96 is moved by the cable 94. The pin springs 132 bias the pin 96 toward the stationary member 50. In one example, a pair of cables 94 are coupled to the handle 92 and the stationary member 50, and the stationary member 50 includes a pair of first notches 52 and a pair of second notches 54 which can be engaged by a pair of pins 96. The handle 92 can include a first member 133 and a second member 134 transverse to the first member 133. The handle 92 is pivotably coupled to the pivot member 60 such that first member 133 rotates toward to the pivot member 60 and the second member 134 pulls the cable 94 when an actuation force C is applied. In one example, a handle bracket 137 couples the handle 92 to the pivot member 60. Covers 135, 136 can be included to protect the latching device 90 from external forces and align the latching device 90 with the second side 72.

In the present description, certain terms have been used for brevity, clearness and understanding. No unnecessary imitations are to be implied therefrom beyond the requirement of the prior art because such terms are used for descriptive purposes only and are intended to be broadly construed. The different devices and apparatuses described herein may be used alone or in combination with other devices and apparatuses. Various equivalents, alternatives and modifications are possible within the scope of the appended claims.

What is claimed is:

1. A combination chair and desk apparatus comprising:

a frame;

a stationary member connected to the frame;

a pivot member that is pivotable with respect to the stationary member between a chair position and a table position, the pivot member having a chair surface and a table surface that is transverse to the chair surface; and a latching device that latches the pivot member to the stationary member in the chair position and alternately in the table position;

wherein when the pivot member is in the chair position, the chair surface is oriented for supporting a user, and wherein when the pivot member is in the table position, the table surface is oriented for supporting an object;

wherein when the pivot member is in the chair position, the chair surface is generally horizontal, and wherein when the pivot member is in the table position, the table surface is generally horizontal; and the pivot member comprising a first side and a second side that is opposite the first side, wherein the chair surface and the table surface are on the first side.

2. The combination chair and desk apparatus of claim 1, wherein when the pivot member is in the table position, the table surface is located higher than the chair surface when the pivot member is in the chair position.

3. The combination chair and desk apparatus of claim 2, wherein a recess is formed in the table surface for holding objects.

4. The combination chair and desk apparatus of claim 1, the latching device comprising a handle coupled to the second side, opposite the table surface.

5. The combination chair and desk apparatus of claim 4, wherein the latching device further comprising a cable coupled to the second side such that the cable extends along the second side opposite both the chair surface and the table surface.

6. The combination chair and desk apparatus of claim 1, wherein the stationary member comprises a first notch and a second notch that is transverse to the first notch, wherein when the pivot member is in the chair position, the latching mechanism engages the first notch and wherein when the pivot member is in the table position, the latching mechanism engages the second notch.

7. The combination chair and desk apparatus of claim 6, wherein the stationary member defines a pivot axis and the first and second notches extend in the radial direction.

8. The combination chair and desk apparatus of claim 7, wherein the stationary member is elongated along the pivot axis.

9. The combination chair and desk apparatus of claim 7, wherein the latching device comprises a pin that engages the first notch when the pivot member is in the chair position and the second notch when the pivot member is in the table position.

10. A combination chair and desk apparatus comprising:

a frame;

a stationary member connected to the frame;

a pivot member that is pivotable with respect to the stationary member between a chair position and a table position, the pivot member having a chair surface and a table surface that is transverse to the chair surface; and a latching device that latches the pivot member to the stationary member in the chair position and alternately in the table position;

wherein when the pivot member is in the chair position, the chair surface is oriented for supporting a user, and wherein when the pivot member is in the table position, the table surface is oriented for supporting an object;

wherein the stationary member comprises a first notch and a second notch that is transverse to the first notch, wherein when the pivot member is in the chair position, the latching mechanism engages the first notch and wherein when the pivot member is in the table position, the latching mechanism engages the second notch;

wherein the stationary member defines a pivot axis and the first and second notches extend in the radial direction;

wherein the latching device comprises a pin that engages the first notch when the pivot member is in the chair position and the second notch when the pivot member is in the table position; and the latching device comprising a handle coupled to the pivot member and a cable that couples the pin to the handle, wherein actuation of the handle causes the cable to move the pin out of engagement with the stationary member such that the pivot member can rotate about the stationary member.

11. The combination chair and desk apparatus of claim 10, wherein the cable is coupled to the pivot member and extends along the second side, opposite both the table surface and the chair surface.

12. A combination chair and desk apparatus comprising:

a frame;

a stationary member connected to the frame;

a pivot member that is pivotable with respect to the stationary member between a chair position and a table position, the pivot member having a chair surface and a table surface that is transverse to the chair surface; and a latching device that latches the pivot member to the stationary member in the chair position and alternately in the table position;

wherein when the pivot member is in the chair position, the chair surface is oriented for supporting a user, and wherein when the pivot member is in the table position, the table surface is oriented for supporting an object;

the frame defining a rotational axis and comprising a restrictor device having a upper locking member and a lower locking member capable of mating with the upper locking member, wherein the upper and lower locking members mate to prevent rotation of the pivot member with respect to the rotational axis.

13. The combination chair and desk apparatus of claim 12, wherein the restrictor device comprises a spring biasing the lower and upper locking members into mating engagement.

14. The combination chair and desk apparatus of claim 13, wherein the upper locking member comprises a plurality of teeth that mate with a plurality of voids defined by the lower locking member.

15. The combination chair and desk apparatus of claim 14, wherein the lower locking member comprises a plurality of teeth that mate with a plurality of voids defined by the upper locking member.

16. The combination chair and desk apparatus of claim 12, wherein the lower locking member is coupled to the pivot member.

* * * * *